United States Patent [19]

Galizia et al.

[11] Patent Number: 4,666,227

[45] Date of Patent: May 19, 1987

[54] FEMALE ELECTRICAL CONTACT ELEMENT REQUIRING RELATIVELY LITTLE CONNECTING FORCE AND RELATIVE CONNECTOR ASSEMBLY

[75] Inventors: Mauro Galizia; Franco Trevisiol, both of Turin, Italy

[73] Assignee: Burndy Electra S.p.A., Turin, Italy

[21] Appl. No.: 813,546

[22] Filed: Dec. 26, 1985

[30] Foreign Application Priority Data

Dec. 28, 1984 [IT] Italy ..... 68282 A/84

[51] Int. Cl.[4] ..... H01R 13/62

[52] U.S. Cl. ..... 339/64 M; 339/258 P

[58] Field of Search ..... 339/258 R, 258 P, 64

[56] References Cited

U.S. PATENT DOCUMENTS

| | | | |
|---|---|---|---|
| 3,120,418 | 2/1964 | Deakin | 339/258 R |
| 3,894,783 | 7/1975 | Messner | 339/258 R |
| 4,002,400 | 1/1977 | Evans | 339/258 R |

*Primary Examiner*—Joseph H. McGlynn

*Attorney, Agent, or Firm*—Shlesinger, Arkwright, Garvey & Fado

[57] ABSTRACT

Female electrical contact element comprising a first portion designed to receive a corresponding male electrical contact element with relatively little connecting force; the said first portion being essentially cylindrical in shape and presenting a section having contact zones of relatively small area.

11 Claims, 10 Drawing Figures

FEMALE ELECTRICAL CONTACT ELEMENT REQUIRING RELATIVELY LITTLE CONNECTING FORCE AND RELATIVE CONNECTOR ASSEMBLY

BACKGROUND OF THE INVENTION

The present invention relates to a female electrical contact element, especially suitable for use on vehicle accessory gearboxes, and to the relative connector assembly.

Such applications are known to require relatively small electrical contact elements enabling a number of the latter to be housed in a connector block, not only for supplying the said accessory gearboxes with power, but also for enabling exchange of various operating signals. The design of the connecting portions on the said electrical contact elements must be such as to ensure permanently reliable, stable contact, while at the same time requiring relatively little force, i.e. about a few hundred grams. For connecting the male and female contact elements, so as to prevent excessive strain on the part of operators repeatedly connecting the said connector blocks comprising a number of the said electrical contact elements.

SUMMARY OF THE INVENTION

The aim of the present invention is to provide a female electrical contact element and a relative connector assembly enabling such achievements, i.e. one that is relatively small, ensures stable operation and requires relatively little connecting force.

With this aim in view, the present invention relates to a female electrical contact element comprising a first portion designed to receive a corresponding male electrical contact element with relatively little connecting force, characterised by the fact that the said first portion is essentially cylindrical and presents a section having contact zones of relatively small area.

BRIEF DESCRIPTION OF THE DRAWINGS

A number of specific embodiments of the present invention will now be described, purely by way of non-limiting examples, with reference to the attached drawings in which.

DETAILED DESCRIPTION OF THE INVENTION

Figure 4:
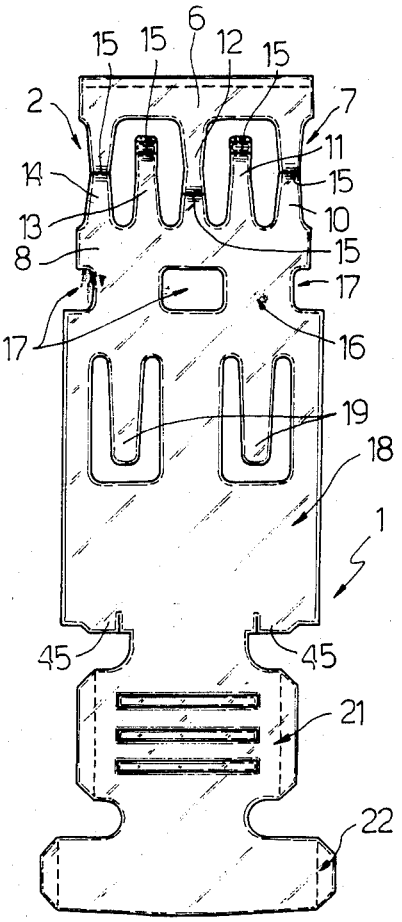
FIG. 4 shows a flat view of the female electrical contact element in FIGS. 1 and 2.
Figure 1:
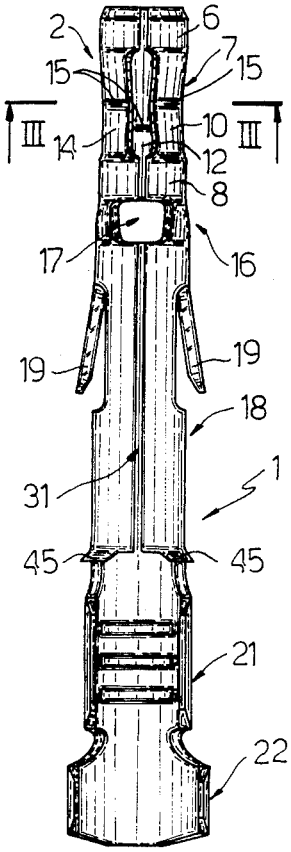
FIGS. 1 and 2 show a top and side view respectively of the female electrical contact element according to the present invention.
Figure 3:
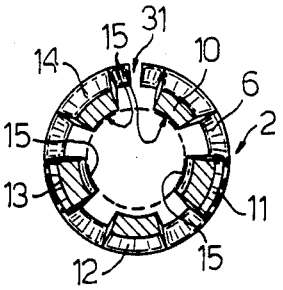
FIG. 3 shows an enlarged section along line III—III in FIG. 1.
Figure 5:
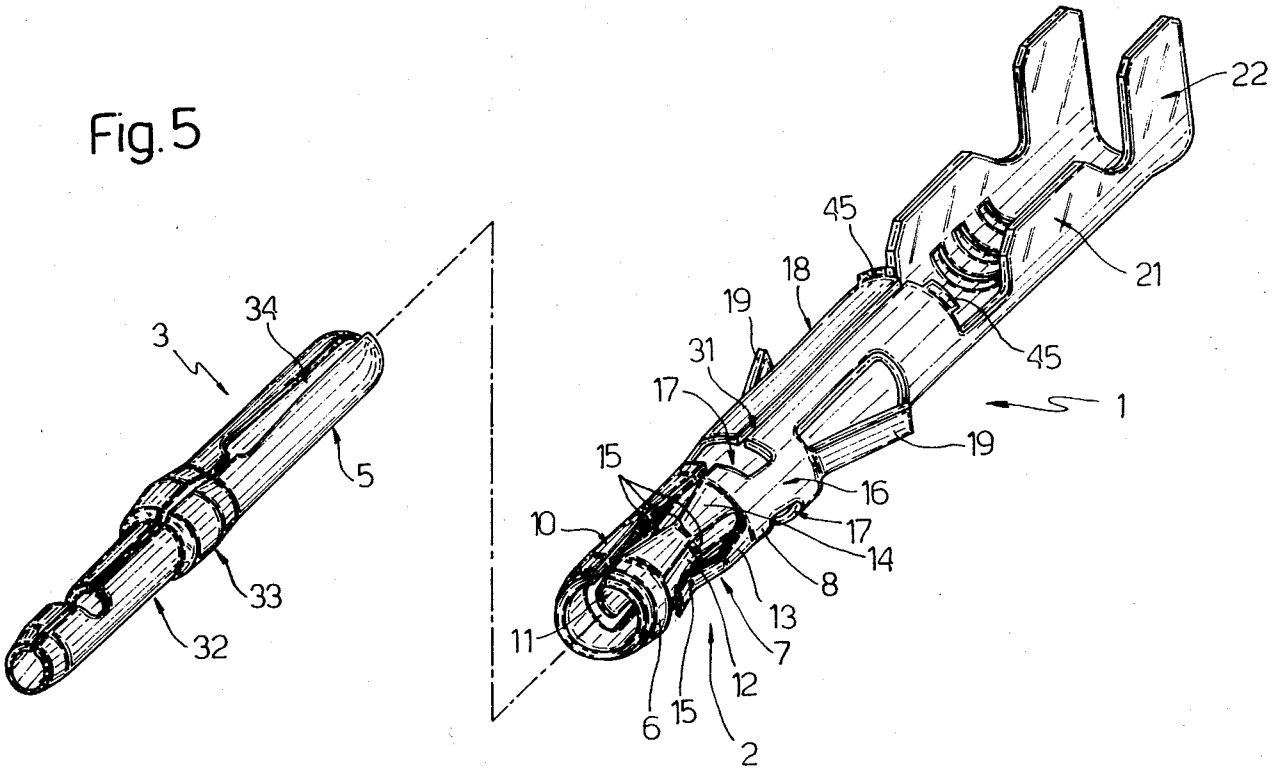
FIG. 5 shows a view in perspective of the female electrical contact element in FIGS. 1 and 2, connectable to a male electrical contact element.

Number 1 in FIGS. 1 to 4 indicates a female electrical contact element according to the present invention and presenting, at the front, an essentially cylindrical first portion 2 designed to receive the front part 5, also essentially cylindrical, of a male electrical contact element 3 (FIG. 5). The said portion 2 of female electrical contact element 1 presents an essentially circular-section first part 6, a centre section 7 with relatively small-area contact zones, as described in more detail later on, and a second essentially circular-section part 8 opposite the said first part 6. The said centre section 7 is formed of five tabs, 10, 11, 12, 13 and 14, equallyspaced angularly and arranged parallel with the longitudinal axis of female electrical contact element 1. The said tabs 10 to 14 are relatively flexible and shaped so as each to form an edge 15 facing inwards of the said first portion 2, in such a manner as to form a relatively small-area contact zone on part 5 of male electrical contact element 3, as described in more detail later on. The ends of tabs 10, 12 and 14 are integral with first part 6 and second part 8 at the end of centre section 7, whereas tabs 11 and 13 have their bases integral with second part 8, whereas the other ends, facing first part 6, are free. Edges 15 on tabs 10 to 14 are located at different heights, i.e. edges 15 on tabs 10 and 14 are located halfway up the same, edge 15 on tab 12 is located towards second part 8, and edges 15 on tabs 11 and 13 are located towards the free top ends of the same. Below second part 8 on first portion 2, towards the rear of female electrical contact element 1, there is a second portion 16, also integral and having an opening 17 for increased flexibility, as described in more detail later on, and an essentially cylindrical third portion 18 with outward-projecting blanked tongues 19. At the rear end of female electrical contact element 1, U-section portions 21 and 22 are formed in known manner, for gripping and electrically connecting wires 23 and insulating sleeve 24 on external connecting wire 25. As shown in FIG. 4, female electrical contact element 1 is obtained by blanking a flat piece of sheet metal, which is then formed into a cylinder to produce female electrical contact element 1, as shown in FIG. 1, with a slit 31 along the generating line, where the side edges of the sheet metal nearly come together.

As shown in FIG. 5, male electrical contact element 3 is also obtained by blanking sheet metal, which is then formed, with a longitudinal slit 34, into an essentially cylindrical front part 5 and an essentially cylindrical, insertable rear part 32 for electrically connecting other components, the said two parts being separated by largerdiameter intermediate portion 33.

Figure 6:
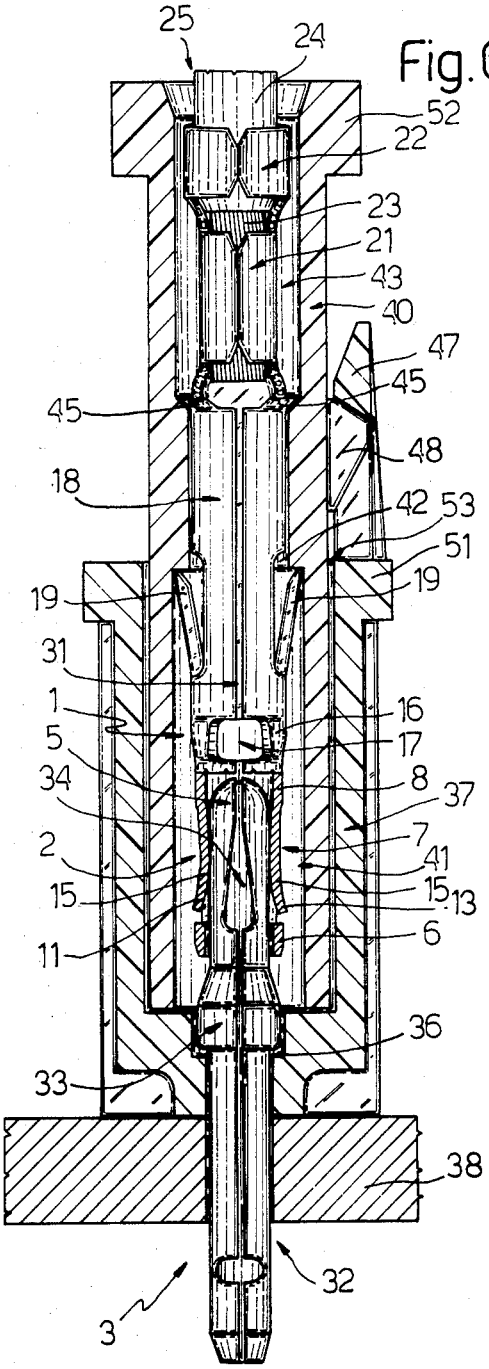
FIG. 6 shows a side section of a first embodiment of the connector assembly according to the present invention and comprising the electrical contact elements in FIG. 5.
Figure 2:
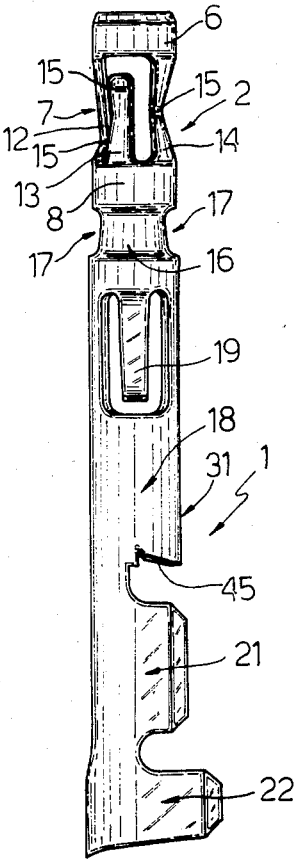

As shown in FIG. 6, the said intermediate portion 33 fits inside a hole 36 formed at the bottom of a cavity 53 on insulating case 37 which houses a number of the said male electrical contact elements 3 arranged vertically with ends 32 inside a respective hole on base 38 which also acts as a support for insulating case 37. Female electrical contact elements 1 are, in turn, housed in spaced parallel manner inside a respective insulating case 40 which, for housing each of the said female electrical contact elements 1, presents a first front cavity 41, a second intermediate cavity 42 and a third rear cavity 43. The said first front cavity 41 houses, with a much larger diameter, first portion 2, second portion 16 and the first section of third portion 18 with blanked tongues 19, the free ends of the latter resting on the bottom of cavity 41 for preventing withdrawal of female electrical contact element 1 when pull is exerted on electrical wire 25. The second intermediate cavity 42 houses the second part of portion 18 and presents essentially the same diameter as the said second part so as to guide and lock the latter inside insulating case 40. At the end of the said portion 18, provision is made for outturned tongues 45 which abut with the bottom of third rear cavity 43 so as to act as a stop for female eleectrical contact element 1 when the latter is inserted inside insulating case 40. The said third rear cavity 43 houses portions 21 and 22, on female electrical contact element 1, connecting electrical wire 25. Insulating cases 37 and 40 present end collars 51 and 52 respectively.

Operation of female electrical contact element 1 and the relative connector assembly according to the present invention is as follows.

Insulating case 40, housing the various female electrical contact elements 1, is inserted inside cavity 53 on insulating case 37, housing the various male electrical contact elements 3, until flexible tongue 47 on insulating case 37 engages with outer hook 48 on insulating case 40 (FIG. 6). Accordingly, front parts 5 on male electrical contact elements 3 are inserted inside first portions 2 on female electrical contact elements 1, for which connection very little force, conveniently of about 300 grams each, is required. This is achieved by virtue of the contact zones between male and female electrical contact elements 3 and 1 being relatively small and essentially restricted to respective edges 15 on tabs 10 to 14 resting on front part 5. In fact, circular-section first part 6 essentially serves as a lead-in for front part 5 on male electrical contact element 3, the contact zones existing only on centre section 7 of first portion 2. Furthermore, the said contact zones, by virtue of being spaced along the axis of centre section 7 as already stated, do not operate simultaneously, the required connecting force being exerted at different times during insertion. The said insertion force is also reduced by virtue of the relatively flexible nature of tabs 10 to 14, and improved by tabs 11 and 13 which, being secured at one end only, provide for greater spacing of respective contact edges 15 as compared with edges 15 on integral tabs 10, 12 and 14. The number of the said contact edges 15 is, in any case, sufficient for supplying the required amount of current. The relatively large diameter of front cavity 41 as compared with that of first electromechanical connecting portion 2 on female electrical contact element 1 provides for adapting the position of first portion 2 during insertion, as well as for reducing the connecting force required. The latter effect is further achieved by openings 17 in portion 16, which enable better positioning of the said first portion 2 in relation to portion 18 which is locked inside intermediate cavity 42 on insulating case 40. The said connecting force is also further reduced by virtue of making male and female electrical contact elements 3 and 1 from blanked sheet metal, which is then formed into a cylinder to produce respective slits 34 and 31 which, during insertion, enable appropriate adaptation of the respective diameters of contact elements 3 and 1.

Figure 7:
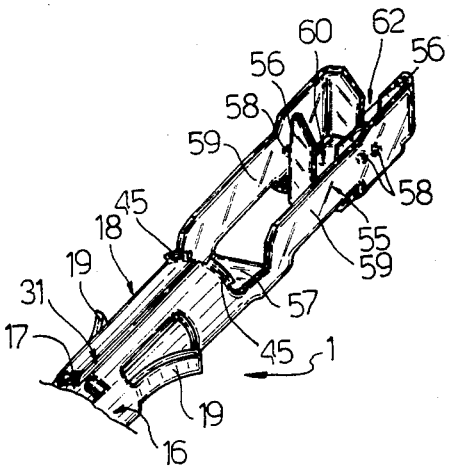
FIG. 7 shows a partial view in perspective of an alternative arrangement of the rear end of the female electrical contact element in FIG. 5.
Figure 8:
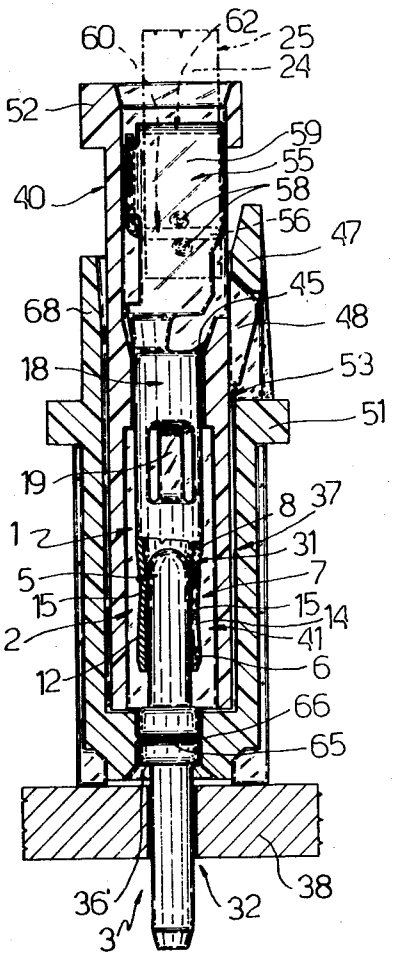
FIG. 8 shows a side section of a second embodiment of the connector assembly according to the present invention and comprising the female electrical contact element in FIG. 7.

FIG. 7 shows an alternative arrangement of the rear part of female electrical contact element 1, the said rear part being designed for connection to external wire 25 by cutting the insulating sleeve on the latter. In more detail, in place of the said two U-section portions 21 and 22, the said female electrical contact element 1 presents a single channel-shaped portion 55 from the base 57 of which two tongues 56 are cut, bent upwards and fitted, perpendicular to base 57, between two pairs of bosses 58 formed on side walls 59 on channel portion 55. Between the said two tongues 56, a slit 60, considerably narrower than the diameter of wire 25, is formed so that, when the said wire 25 is inserted, insulating sleeve 24 is cut by the edges of the said tongues 56, thus enabling electrical connection with wires 23 (FIG. 8). The end sections of side walls 59 are bent perpendicularly inwards to form a slit 62 slightly narrower than the diameter of wire 25 and such as to secure insulating sleeve 24.

Figure 9:
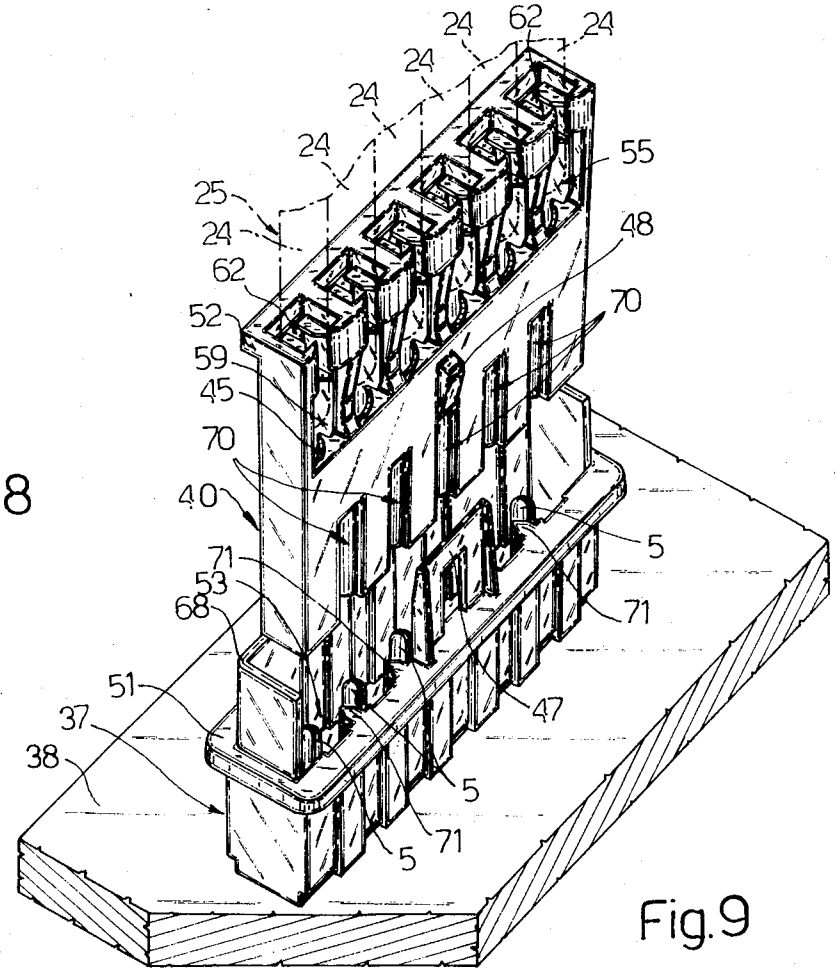
FIG. 9 shows a view in perspective of the FIG. 8 connector assembly disconnected.

FIG. 8 shows an alternative arrangement of the connector assembly shown in FIG. 6. In the FIG. 8 arrangement, the rear part of female electrical contact element 1 is as shown in FIG. 7, whereas the intermediate portion 33 of male electrical contact element 3 presents an annular cavity 65 inside which is designed to click flexibly an annular projection 66 formed inside a constant-diameter through hole 36' (thus enabling male electrical contact element 3 to be inserted inside the insulating case either from the outside or via cavity 53). As shown more clearly in FIG. 9, on collar 51 of insulating case 37, an integral wall 68 is formed about three adjacent sides (one long and two short) of cavity 53, for the purpose of guiding insertion of insulating case 40. As also shown in FIG. 9, the longer side walls of insulating case 40 present a number of foolproof cavities 70 (with corresponding projections 71 on the side walls of insulating case 37) for preventing mispositioning or mismatching of different pairs of cases 37 and 40. The circular design of the cavities housing female electrical contact elements 1 inside case 40 enables the said foolproof means in the form of cavities 70 on insulating case 40 to be formed in the spaces between the said inside cavities, instead of in the form of external projections, thus enabling compact external design of the said insulating cases, as well as of the connector assembly as a whole.

Figure 10:
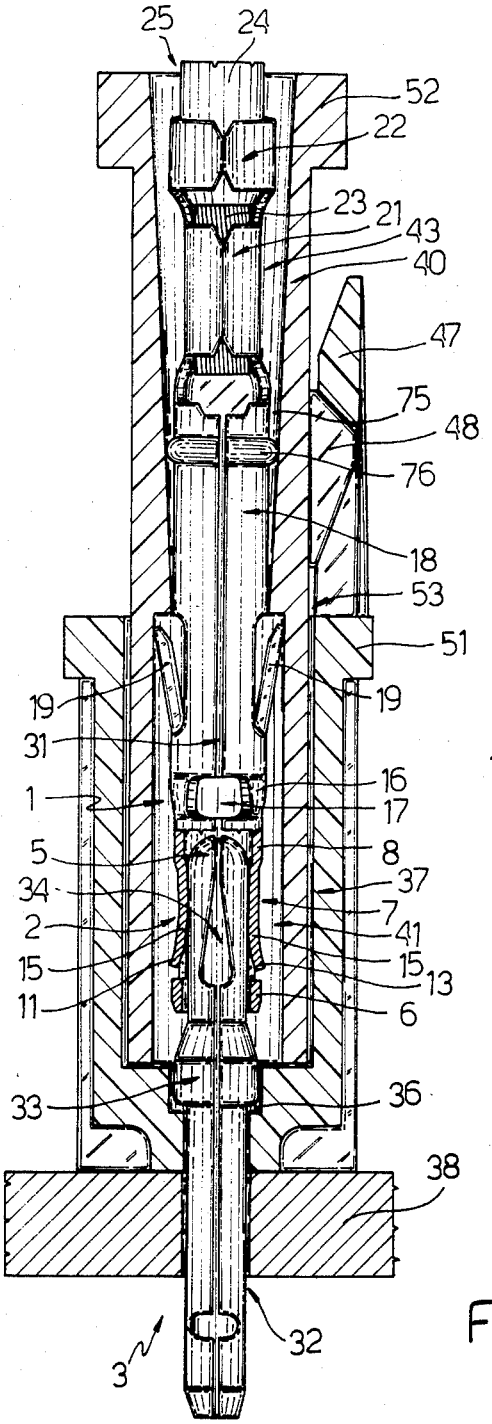
FIG. 10 shows a partial side section of an alternative arrangement of the female electrical contact element according to the present invention, housed inside its respective connector.

FIG. 10 shows an alternative arrangement of female electrical contact element 1 and relative insulating case 40. The two cavities 42 and 43 in the FIG. 6 arrangement are replaced by a single truncated-cone cavity 75 tapering inwards towards front cavity 41 to which it is still joined, however, by a step, and portion 18 of female electrical contact element 1 is provided with an annular projection 76 for locking the said portion 18 inside cavity 75.

The advantages of the female electrical contact element and relative connector assembly according to the present invention will be clear from the foregoing description. Despite the relatively small diameter (about 2 mm) of the said male and female electrical contact elements 3 and 1, they provide for permanently stable, reliable contact, re latively little connecting force and may be assembled fully automatically (mutual angular positioning of electrical contact elements 1 and 3 is of no importance).

To those skilled in the art it will be clear that changes may be made to the design and arrangement of the male and female electrical contact elements and relative connector assembly as shown in the embodiments described and illustrated herein without, however, departing from the scope of the present invention.

For example, male electrical contact element 3 may be formed in one solid piece, e.g. on a lathe. Instead of being inserted inside base 38, rear part 32 on the said male electrical contact element 3 may be connected to electrical wires and may present the same end configuration as on female electrical contact elements 1 as shown, for example, in FIGS. 5 or 7.

The number of tabs 10, 11, 12, 13 and 14 may be varied as required, as may the number of tabs with only one integral end. Furthermore, the free tab end may be arranged indifferently facing first part 6 or second part 8.

What is claimed is:

1. A female electrical contact element comprising:

(a) a first end portion for receiving with relatively little connecting force a corresponding male electrical contact;

(b) a second end portion for receiving the end of an electrical wire;

(c) an intermediate portion between said first end portion and said second end portion;

(d) said first end portion being generally cylindrical in shape and including angularly spaced relatively flexible tabs;

(e) said tabs including inwardly directed portions forming contact surfaces for engaging said male contact element;

(f) said contact surfaces having a relatively small surface contact area and being located at at least two heights relative to the axis of said female contact element;

(g) said tabs being bounded at one end by a first relatively uninterrupted annular ring;

(h) said tabs being bounded at their other ends by a second relatively uninterrupted annular ring;

(i) at least some of said tabs extending between and interconnecting said first annular ring and said second annular ring;

(j) a third annular ring positioned between and interconnecting said second annular ring and said intermediate portion; and, (k) said third annular ring including at least one opening formed therein thereby providing flexibility between said first end portion and said intermediate portion, allowing for any temporary misalignment and subsequent realignment of said first end portion relative to said intermediate portion during relative engagement of said male electrical contact element with said first end portion of said female electrical contact element.

2. A female electrical contact element as in claim 1, wherein:

(a) said opening in said third annular ring being generally rectangular in shape.

3. A female electrical contact element as in claim 1, wherein:

(a) said female electrical contact element being made from blanked, formed sheet metal.

4. A female electrical contact element as in claim 1, wherein:

(a) said tabs are angularly spaced at an equal distance from one another.

5. A female electrical contact element as in claim 1, wherein:

(a) some of said tabs are connected only to one of said first or said second annular rings.

6. An electrical connector comprising:

(a) a female electrical contact element having a first end portion including means for receiving and electrically connecting with relatively little connecting force a corresponding male electrical contact element, a second end portion for receiving the end of an electrical wire, an intermediate portion between said first end portion and said second end portion, and an annular ring between said first end portion and said intermediate portion, said annular ring including at least one opening formed therein for providing flexibility between said first end portion and said intermediate portion;

(b) an insulating case for housing at least one female electrical contact element, said insulating case having a first cavity and at least one additional cavity axially aligned with said first cavity;

(c) said first cavity for housing and providing lateral clearance for said first end portion and said annular ring of said female electrical contact element;

(d) said additional cavity for housing and constraining against lateral movement said intermediate portion of said female electrical contact element; and, (e) said lateral clearance provided by said first cavity allowing misalignment and subsequent realignment of said first end portion relative to said intermediate portion during relative engagement of said female electrical contact element with a corresponding male electrical contact element.

7. An electrical connector as in claim 6, wherein:

(a) said female electrical contact element and said insulating case including cooperating means for essentially preventing axial displacement of said female electrical contact element with respect to said insulating case when said female electrical contact element is housed in said insulating case.

8. An electrical connector assembly comprising:

(a) a female electrical contact element including a first end portion, a second end portion for receiving the end of an electrical wire, an intermediate portion between said first end portion and said second end portion, an annular ring between said first end portion and said intermediate portion, said annular ring including at least one opening formed therein for providing flexibility between said first end portion and said intermediate portion;

(b) an essentially cylindrical male electrical contact element having a first end portion receivable with relatively little connecting force within said first end portion of said female electrical contact element, and a second end portion;

(c) a first insulating case for housing at least one of said female electrical contact elements, said first insulating case having a first cavity and at least one additional cavity axially aligned with said first cavity;

(d) said first cavity for housing and providing lateral clearance for said first end portion and said annular ring of said female electrical contact element;

(e) said additional cavity for housing and for constraining against lateral movement said intermediate portion of said female electrical contact element, (f) a second insulating case including an inside cavity for receiving and housing said first insulating case; and, (g) said second insulating case supporting said second end portion of at least one of said male electrical contact elements.

9. An electrical connector assembly as in claim 8, wherein:

(a) said male electrical contact element includes an intermediate portion between said first end portion and said second end portion; and, (b) said second insulating case includes means for receiving and positioning said intermediate portion of said male electrical contact element.

10. An electrical connector assembly as in claim 8, wherein:

(a) said second insulating case includes guide means for receiving and guiding said first insulating case during relative insertion of said first insulating case into said second insulating case.

11. An electrical connector assembly as in claim 8, wherein:

(a) said first insulating case and said second insulating case having cooperating means for ensuring foolproof connection therebetween.

* * * * *